United States Patent [19]

Juve et al.

[11] Patent Number: 4,972,391

[45] Date of Patent: Nov. 20, 1990

[54] BREAST FEEDING TIMER

[76] Inventors: Ronald A. Juve; Diane M. Dancer, both of 4527 Patton Ave., Boise, Id. 83704

[21] Appl. No.: 473,232

[22] Filed: Jan. 31, 1990

[51] Int. Cl.[5] ..... G04B 47/00; G04F 8/00

[52] U.S. Cl. ..... 368/10; 368/110; 368/113

[58] Field of Search ..... 368/10, 107–113, 368/96

[56] References Cited

U.S. PATENT DOCUMENTS

| | | | |
|---|---|---|---|
| 4,062,180 | 12/1977 | Mesh et al. | 368/96 |
| 4,423,734 | 12/1983 | Schawel | 450/37 |
| 4,505,595 | 3/1985 | Rose et al. | 368/110 |
| 4,797,804 | 1/1989 | Stawo et al. | 368/111 |

*Primary Examiner*—Vit W. Miska

*Attorney, Agent, or Firm*—Frank J. Dykas; Craig M. Korfanta

[57] ABSTRACT

One embodiment of this invention has an electronic circuit which is configured to count the elapsed time in minutes since the initiation of a nursing session. The elapsed time is indicated on a visual display (23) which also includes a right/left breast subdisplay (23*d*) for indicating the breast from which the baby last fed, which is also the breast to be used when the baby starts feeding again. Breast feeding timer (10) includes a reference clock (11), a clock counter (14), an alarm counter (16), a three digit digital display (23), including a separate right/left subdisplay (23*d*), an audible alarm (26), and plurality of switches for controlling and initiating stop, start, reset, alarm program, and right/left selection display functions.

22 Claims, 7 Drawing Sheets

BREAST FEEDING TIMER

DESCRIPTION

BACKGROUND OF THE INVENTION

1. Technical Field.

This invention generally relates to electronic timers, and in particular, it relates to an electronic breast feeding timer and alarm for timing feeding durations, intervals between feedings, indicating from which breast the baby last fed, and reminding the mother that it is time to switch the baby to the other breast during a feeding session.

2. Background Art.

The resurgence of breast feeding has produced a heightened awareness among the medical community and nursing mothers concerning difficulties encountered while breast feeding. It is generally accepted that the best way to reduce nursing related problems and physical discomfort, and at the same time insure an equal and adequate supply of milk from both breasts, is to maintain a fairly set feeding pattern. The preferred feeding pattern has the baby nursing from both breasts during any one particular feeding. Because the baby feeds most vigorously at the beginning of a feeding session, the breast last nursed during the previous session is the one on which the next session should start. After the baby has fed from the first breast for a period of time, usually about ten minutes, the mother switches the baby to the other breast and allows the baby to finish feeding on the second breast.

While the preferred feeding pattern is simple enough in theory, in practice it can be very difficult for the mother to remember from which breast the baby last fed and to make sure that the baby is not allowed to feed too long on the first breast, thereafter neglecting the second breast and allowing it to become painfully engorged. Oftentimes, it is also necessary to monitor the length of time between feedings, and the length of time of each feeding. Keeping track of the breast from which the baby last fed, how long the baby has been feeding on the first breast, how long each feeding session lasts, and the length of time between feedings can be quite confusing and complicated, especially for an anxious new mother.

To help mothers remind themselves from which breast the baby last fed, SCHAWEL, U.S. Pat. No. 4,423,734, teaches a nursing bra with an indicator switch having two positions, one designating the right breast and one designating the left breast. While this device serves as a reminder as to the breast from which the baby last nursed, in order to use the reminding feature, the mother must always be wearing the bra. Also, the device does not make any provisions for timing the various feeding related events, nor does it provide a reminder feature to remind the mother that it is time to change the baby from one breast to another during a feeding session.

What is needed is a device which keeps track of the breast from which the baby last fed, the time interval between feedings, and the elapsed time since the initiation of the current feeding session. What is also needed is a device which alerts the mother to the fact that a particular preselected time interval has passed since the initiation of the current feeding session and that it is now time to switch breasts.

Accordingly, it is an object of the present invention to provide a timing device which displays a visual indication of which breast the baby last fed from, the length of time between feeding sessions, and the length of time elapsed since the initiation of the current feeding session. It is a further object of the present invention to provide a programmable alarm by which the mother is made aware that a preselected time interval has expired and it is now time to switch the baby to the second breast.

DISCLOSURE OF INVENTION

These and other objects are accomplished by an electronic circuit which is configured to count the elapsed time in minutes since the initiation of a feeding session. The elapsed time is indicated on a visual display which also includes a right/left breast indicator for indicating the breast from which the baby last fed, which is also the breast to be used when the baby starts feeding again.

The breast feeding timer has a reference clock, a clock counter, an alarm counter, a three digit digital display including a separate right/left subdisplay, an audible alarm, and plurality of switches for controlling and initiating stop, start, reset, alarm program, and right/left selection display functions.

The alarm counter can be programmed with a predetermined time interval via a separate alarm program clock. The alarm program clock uses the reference clock signal, the start/stop switch along with an alarm program switch to generate several different frequencies of alarm program signals for advancing the alarm counter. The state of the alarm program switch determines whether the contents of the alarm counter or the contents of the clock counter are displayed on the display. After a timing interval is initiated, a digital comparator compares the values present in the clock counter and alarm counter to subsequently activate the alarm when two values are equal. The clock counter continues to advance until it is stopped. Both the alarm counter and clock counter can be reset via a reset switch. A right/left select switch is provided to toggle the right/left subdisplay to alternate the display between a right indication and left indication. A back light control switch is also provided to activate and deactivate a display back light to facilitate reading of the display in low light conditions.

BEST MODE FOR CARRYING OUT INVENTION

Figure 1:
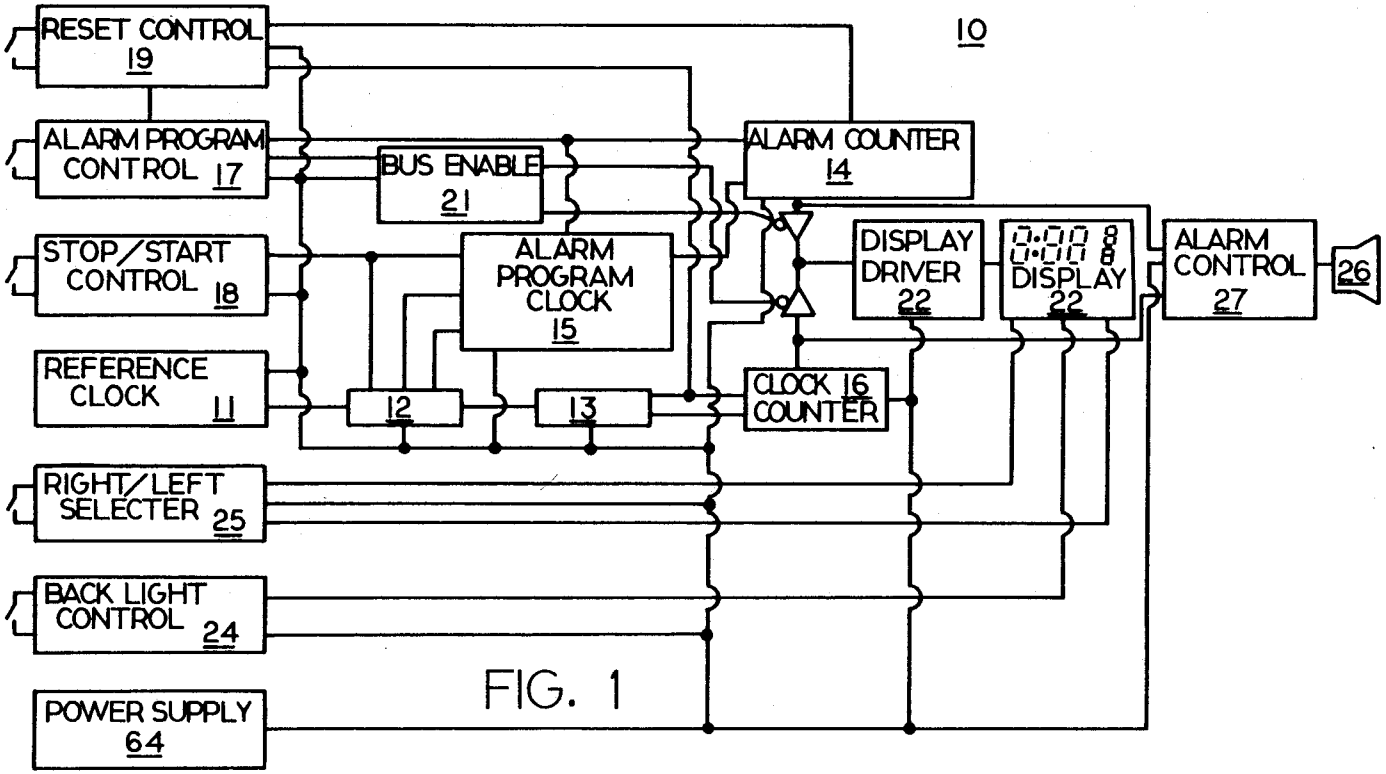
FIG. 1 is a block diagram schematic of the breast feeding timer circuit.
Figure 2A:
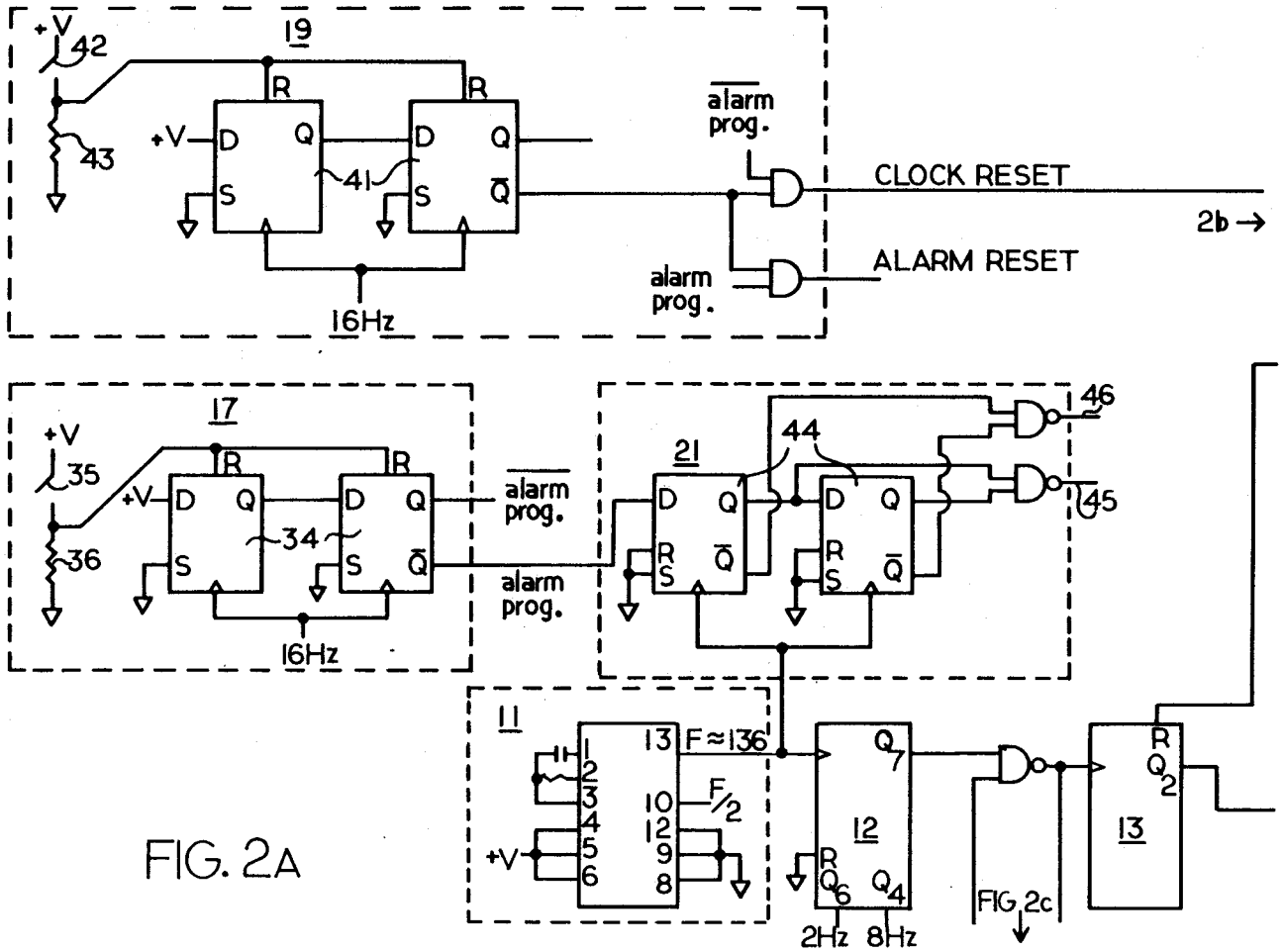
FIG. 2*a* is an exploded partial detailed circuit schematic of the breast feeding timer circuit.
Figure 2B:
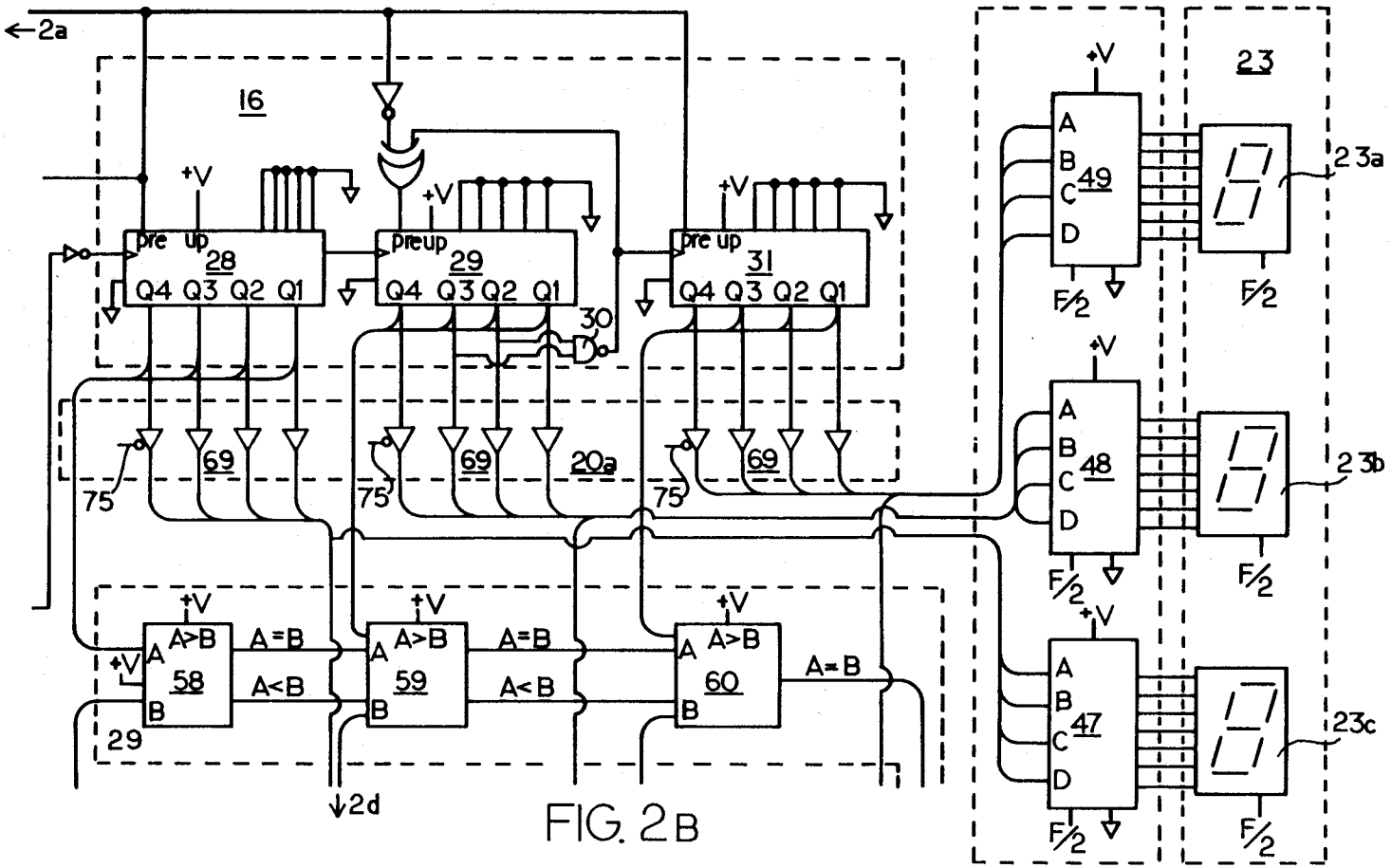
FIG. 2*b* is an exploded partial circuit schematic of the breast feeding timer.
Figure 2C:
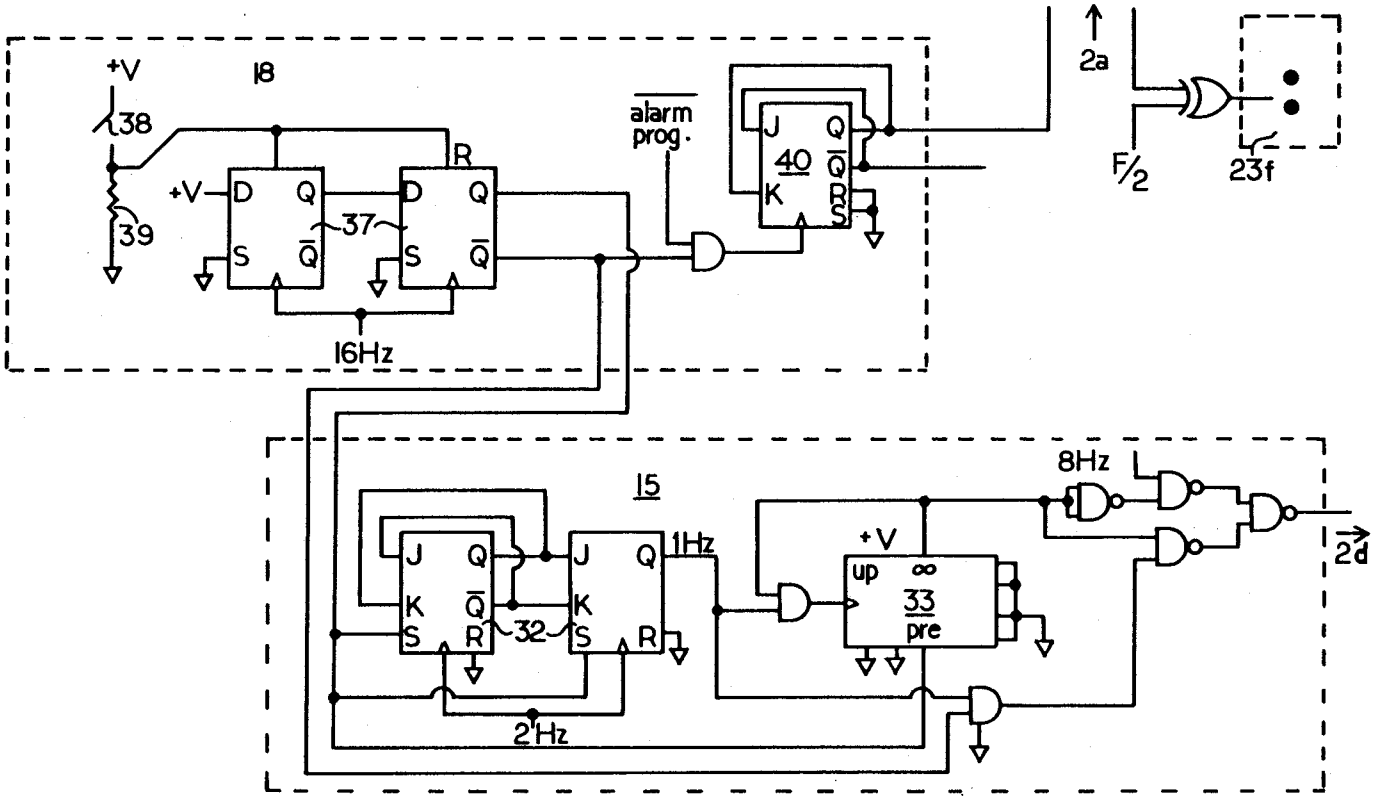
FIG. 2*c* is an exploded partial circuit schematic of the breast feeding timer.
Figure 2D:
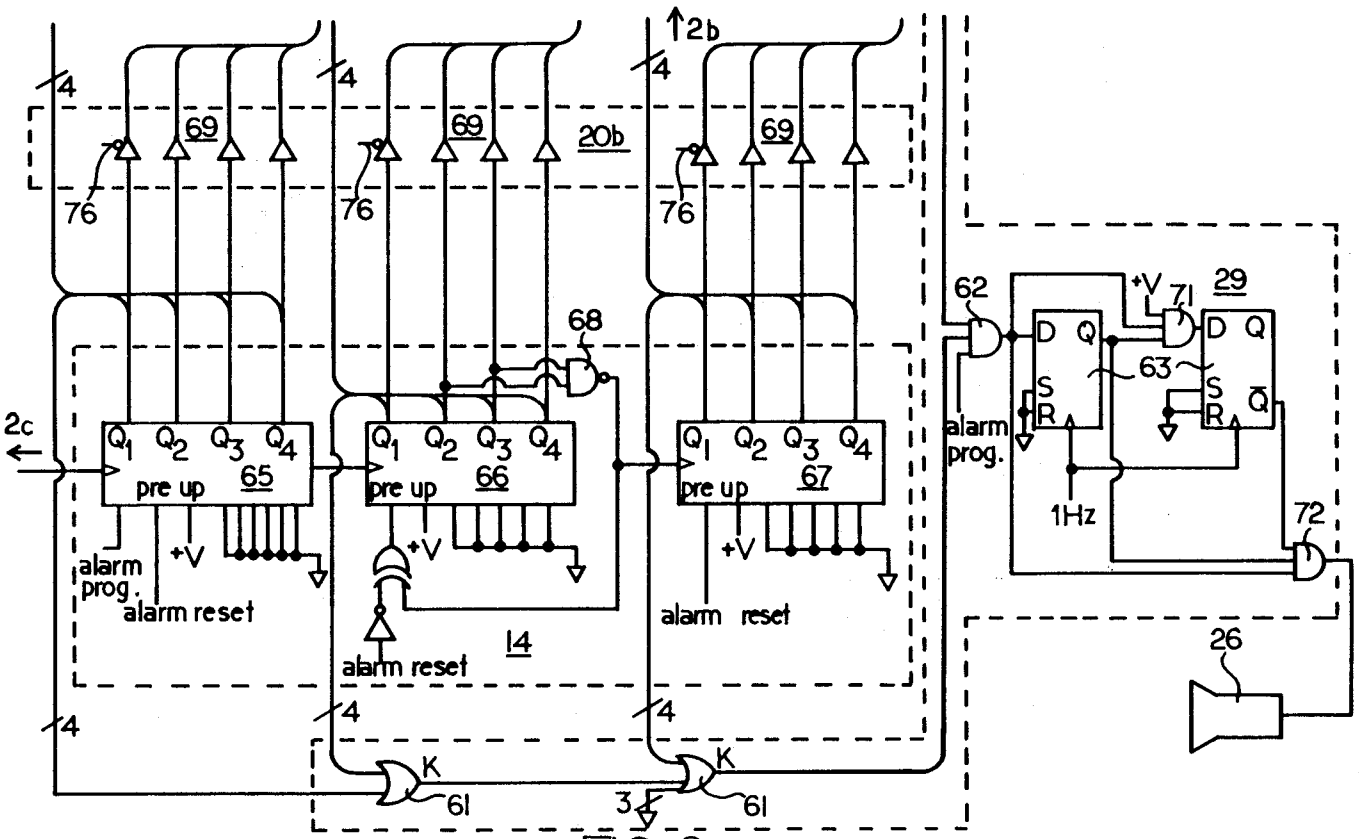
FIG. 2*d* is an exploded partial circuit schematic of the breast feeding timer.

A block circuit diagram of the breast feeding timer 10 is shown in FIG. 1. Breast feeding timer 10 uses a reference clock 11 to generate a pair of continuous clock pulses, both of known frequency with one equal to one-half of the other. The output of reference clock 11 is routed through a first binary divider 12 and subsequently to a second binary divider 13. First binary divider 12 produces four distinct clock signals, here a one hertz signal, a two hertz signal, an eight hertz signal and a sixteen hertz signal. The one hertz signal is routed to second binary divider 13 while the two and eight hertz signals are routed to alarm program clock 15. The sixteen hertz signal is routed to D flip flop pairs used to debounce the various switches. Alarm program clock 15 uses the two hertz and eight hertz signals to generate an alarm program clock signal which is routed to alarm counter 14. Alarm program clock 15 is connected and responsive to both alarm program control 17 and stop/-start control 18.

Alarm program control 17 is also connected to bus enable 21, which determines whether the output of clock counter 16 or the output of clock counter 14 is routed to display 23 through display driver 22. Enabling alarm program control 17 will display the contents of alarm counter 14 on display 23, while the converse will display the contents of clock counter 16.

A reset control 19 is provided for resetting alarm counter 14 and clock counter 16 and is connected and responsive to alarm program control 17. The state of alarm program control 17 determines whether clock counter 16 is reset or alarm counter 14 is reset. An alarm control 27 is connected to the output of alarm counter 14 and clock counter 16. Alarm control 27 compares the contents of clock counter 16 with the contents of alarm counter 14 and will generate an alarm enable signal in the event that the two contents are equal. The alarm enable signal from alarm control 27 is routed to an audible alarm 26.

Right/Left selector 25 and back light control 24 are both connected to display 23 and control the state of the right/left subdisplay and the display back light.

Power supply 64, typically a dry cell battery, is suitably connected to each of the foregoing components to supply the necessary electric power.

Referring now to FIGS. 2A–2D, a detailed circuit schematic of breast feeding timer 10 is shown in four quadrants. At the heart of the circuit lies reference clock 11, which is here an astable multivibrator, an RCA CD4047. However, it should be noted that a crystal oscillator, or any other suitable frequency reference could be used as desired. Reference clock 11 is configured to produce a pair of clock signals, the first one being approximately one hundred thirty-six hertz, and the second one being one-half of that or approximately sixty-eight hertz. The one hundred thirty-six hertz signal is routed to a first twelve stage ripple carry binary divider 12, an RCA CD4040. First divider 12 is configured to divide the one hundred thirty-six hertz signal by one hundred twenty-eight to produce an approximate one hertz signal. First divider 12 also produces three other frequency signals, a two hertz signal, an eight hertz signal and a sixteen hertz signal. The one hertz signal is then divided by sixty-four, using a second twelve stage ripple carry binary divider 13, again an RCA CD4040. Second divider 13 consequently will produce a signal having a frequency of one cycle per minute. This is the signal which is fed to clock counter 16, specifically first BCD (Binary Coded Decimal) decade counter 28. First BCD decade counter 28 corresponds to the minutes digit and will count up from zero to nine having a four bit binary output. First BCD decade counter 28 is here an RCA CD4029.

First BCD decade counter 28 will produce a carry out when it makes the transition from binary nine to binary zero. This carry out is fed to a second BCD decade counter 29, again an RCA CD4029. Second BCD decade counter 29 corresponds to the tens of minutes digit and is consequently configured to count up from zero to five. This is accomplished using a first dual input NAND gate 30. The middle two bits of a four bit binary output of second BCD decade counter 29 are NANDed by first dual input NAND gate 30. When second BCD counter 29 makes the transition from binary five to binary six, first NAND gate 30 will generate a carry out to third BCD decade counter 31 and a reset to second BCD decade counter 29, thereby resetting second BCD decade counter 29 to zero.

Third BCD decade counter 31, again an RCA CD4029, corresponds to the hours digit and is consequently configured to count up from zero to nine. When clock counter 16 reaches nine hours and fifty-nine minutes, the next clock cycle will recycle clock counter 16 to zero and the counting sequence will continue.

A separate alarm program clock 15 is provided to generate clocking signals when programming alarm counter 14. Alarm program clock 15 uses first JK flip flop pair 32 to create a one hertz alarm program clock signal from the two hertz clock signal after two of the two hertz clock cycles. The one hertz program clock signal is fed to a fourth BCD decade counter 33, again an RCA CD4029. After ten of the one hertz alarm program clock cycles, fourth BCD decade counter 33 will generate a carry out which is subsequently NANDed with an eight hertz clock signal to produce an eight hertz alarm program clock signal for advancing alarm counter 16.

Alarm counter 14 is identical in construction to clock counter 16. A clock advance signal from the output of alarm program clock 15, either a single pulse, a two hertz signal or an eight hertz signal is fed into fifth BCD decade counter 65 which corresponds to the minutes digit and will consequently count up from 0–9. Again, fifth BCD decade counter is an RCA CD4029. Fifth BCD decade counter 65 will produce a carry out signal when the counter makes the transition from a binary 9 to binary 0. This carry out signal is fed to a sixth BCD decade counter 66, again an RCA CD4029. Sixth BCD decade counter 66 corresponds to the tens of minutes digit and is consequently configured to count up from 0 to 5. Again, this is accomplished using a second dual input NAND gate 68 connected at its inputs across the middle two bits of the four bit binary output of sixth BCD decade counter 66. When sixth BCD counter 66 makes the transition from binary 5 to binary 6, second NAND gate 68 will generate a carry out signal to seventh BCD decade counter 67 and a reset signal to sixth BCD decade counter 66, thereby resetting sixth BCD decade counter 66 to 0.

A seventh BCD decade counter 67, again an RCA CD4029, corresponds to the hours digit and is configured to count up from 0 to 9. When alarm counter 14 reaches nine hours and fifty nine minutes, the next clock cycle will recycle alarm counter 14 to zero and the programming advance sequence will continue.

Alarm program control 17 uses a first D flip flop pair 34 in conjunction with a SPST slide switch 35 and first pull down resistor 36 to produce debounced alarm program enable and disable signals. The state of the D flip flop outputs change when switch 35 is closed and will remain in that state up to two of the sixteen hertz clock cycles after the switch is opened. The value of pull down resistor 36 is dependent upon the RC time constant and maximum transition time of the flip flops. For the RCA CD4013 flip flop, the input capacitance is equal to fifteen picofarads while the maximum transition time is fifteen microseconds. The value of first pull down resistor 36 must be as large as possible to minimize power dissipation while small enough to keep the time constant below the maximum switching time allowed. The inventors have found that a value of four hundred twenty two thousand ohms works well. The output of alarm program control 17 is fed to bus enable 21 which subsequently activates display bus control 20 to display either the contents of clock counter 16 or the contents of alarm counter 14.

Stop/start control 18 uses a similar debounced switching configuration with the addition of a JK flip flop to introduce a toggle feature. Stop/start control 18 uses second D flip flop pair 37, CD4013's, a first momentary normally open push button switch 38 and a second pull down resistor 39 to generate stop/start enable and disable signals. The enable output of second D flip flop pair 37 is ANDed with the alarm disable signal from alarm program control 17. This ANDed signal is then fed to a single JK flip flop 40, which toggles the output to enable the one hertz from divider 12 to divider 13. Both the enable and disable signals from second D flip flop pair 37 are additionally fed to alarm program clock 15 and serve as trigger pulses. The alarm disable signal from alarm program control 17 is fed to alarm program counter 14 and serves to disable alarm counter 14 to disregard clock pulses from alarm program clock 15 in the event that alarm program control 17 is not in the program mode.

Reset 19 also uses the previously described debounced switch configuration, here having a third pair of CD4013 D flip flops 41, a second momentary normally open push button switch 42 and a third pull down resistor 43. Reset enable output of reset control 19 is ANDed with the alarm program control enable and disable signals to produce a clock reset and an alarm reset. Both resets are connected to their respective counters 16 and 14. When a reset signal is initiated by depressing second push button switch 42, either clock counter 16 or alarm counter 14 will be reset, dependent upon the state of alarm program control 17.

Alarm program control 17 has its alarm program enable connected to the D input of a first flip flop of a fourth D flip flop pair 44. Bus enable 21 uses fourth D flip flop pair 44 to generate enable signals at alarm counter output enable 45 and clock counter enable output 46. Clock counter output enable 46 is connected to the enable inputs 75 of display bus control **20*a*. Display bus control 20*a* here consists of three RCA CD4503 3-state noninverting buffers 69. Alarm counter output enable 45 is identically connected to the enable inputs 76 of display bus control 20*b*. Display bus control 20*b* again consists of three 3-state noninverting buffers 69. Display bus controls 20*a* and 20*b* act as controllers to alternately display either the contents of clock counter 16 or the contents of alarm counter 14, dependent upon the state of alarm program control 17. Each 3-state noninverting buffer 69 has its four output bits connected to one of the three BCD to seven segment display drivers 47, 48 and 49, all National CD4543's. The first BCD to seven segment display driver 47 corresponds to the minutes digit, while the second BCD to seven segment display driver 48 corresponds to the tens of minutes digit, and the third BCD to seven segment display driver 49 corresponds to the hours digit. The outputs of the three BCD to seven segment display drivers are connected to respective seven segment liquid crystal display (LCD) elements 23*a*, 23*b* and 23*c*. A fourth seven segment LCD element 23*d* is also provided and will be explained later. Display 23 also includes a colon display segment 23*f* which serves to separate display segment 23*a* from display segment 23*b*. Display colon 23*f* is supplied by a combination signal consisting of the sixty eight hertz signal and a one hertz clock pulse. The two signals are exclusive ORed together such that when timer 10 is in its normal timing mode, colon display segment 23*f* will blink at the rate of one hertz, while the colon will appear to be constantly on when timer 10** is stopped. If the clock counter is counting and the alarm program mode is selected, the clock continues to count and the colon continues to blink.

The twelve bit outputs of clock counter 16 and alarm counter 14 are continuously monitored and compared by alarm control 29. Alarm control 29 includes three four-bit magnitude comparators 58, 59 and 60, each an RCA CD4585. First four-bit magnitude comparator 58 has outputs Q1 through Q4 of first BCD decade counter 28 connected to its "A" input and outputs Q1 through Q4 of fifth BCD decade counter 65 connected to its "B" inputs. First four-bit magnitude comparator 58 compares the minutes digit output of clock counter 16 and alarm counter 14. Outputs Q1 through Q4 of second BCD decade counter 29 are connected to the "A" input of second four-bit magnitude comparator 59 while outputs Q1 through Q4 of sixth BCD decade counter 66 are connected to the "B" input of second four-bit magnitude comparator 59. Second four-bit magnitude comparator 59 compares the tens of minutes digits of clock counter 16 and alarm counter 14. Outputs Q1 through Q4 of third BCD decade counter 31 are connected to the "A" input of third four-bit magnitude comparator 60, while outputs Q1 through Q4 of seventh BCD decade counter 67 are connected to the "B" input of third four-bit magnitude comparator 60. Third four-bit magnitude comparator 60 compares the hours digit of clock counter 16 to the hours digit of alarm counter 14. Four-bit magnitude comparators 58, 59 and 60 are also interconnected in a cascade fashion. In this manner, progressively higher digit comparators are aware of the status of the lower digit comparator(s), i.e., third four-bit magnitude comparator 60 will not output an equal enable unless first and second magnitude comparators 58 and 59 are also outputting equal enable signals. The equal enable output of third four-bit magnitude comparator 60 is connected to one input of a three input AND gate 62. Each of the twelve bit outputs of alarm counter 14 are sequentially ORed through a pair of eight input OR gates 61. The output of the OR combination is connected to a second input on three input AND gate 62. The third and remaining input of three input AND gate 62 is connected to the alarm program disable on alarm program control 17. This last connection prevents alarm 26 from being triggered while a user is programing alarm counter 14. The connection between the output of OR gates 61 and the second input of three input AND gate 62 prevents alarm 26 from being triggered when alarm counter 14 is reset to zero. This allows the user to disable the alarm if desired.

The output of three input AND gate 62 is connected to the D input of a first D flip flop of a sixth D flip flop pair 63. Sixth D flip flop pair 63, in combination with three input AND gates 71 and 72 will produce an alarm enable signal for a brief time interval when the clock counter output equals the programmed alarm counter output. This enable is directed to alarm 26 which can either be a self-oscillating device or respond to a supply frequency.

Figure 3:
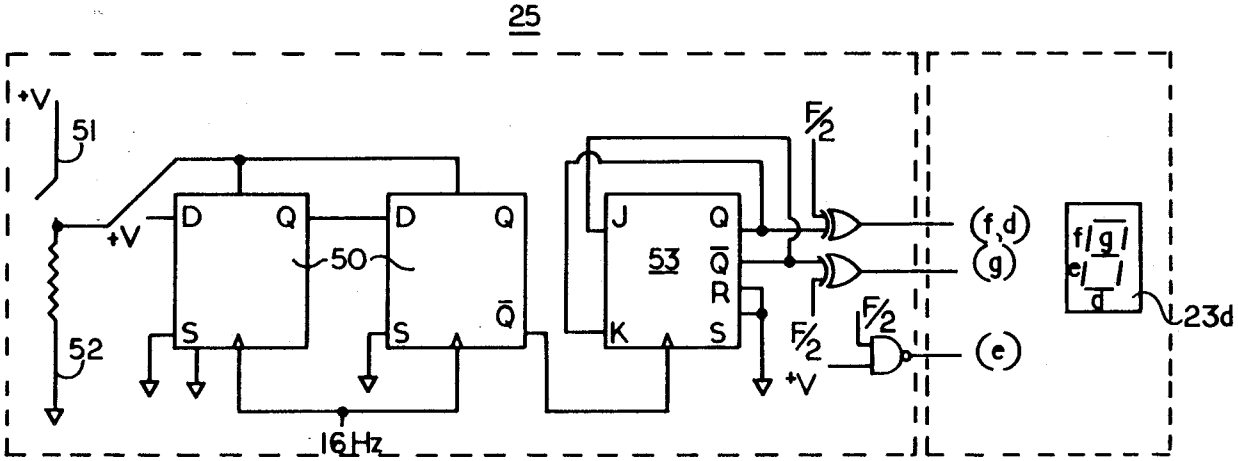
FIG. 3 is a circuit schematic of the right/left indication selector.

Referring now to FIG. 3, the right/left selector circuit 25 is shown. Right/left selector 25 is essentially the same circuit as stop/start control 18, using fourth D flip flop pair 50, again an RCA CD4013, a third momentary normally open push button switch 51, a fourth four hundred twenty two thousand ohm pull down resistor 52 and a fourth JK flip flop 53. Again, this configuration provides a debounced toggle switch which here selects between a right breast indicating signal and a left breast indicating signal. Using a seven segment subdisplay like the one shown at **23*d*, subdisplay 23*d*** will display a capital L, using elements f, e and d, for the left breast indicating signal, and a lower case r, using segments e and g, for a right breast indicating signal. A separate NAND gate, NANDing the sixty eight hertz signal and a positive voltage source, supplies segment e, while segments f and d are driven by the left breast indicating signal and segment g is driven by the right breast indicating signal. It should be noted that by using other display configurations, such as an alfa-numeric display, a dot matrix type display or a custom display, one could display a capital R and a capital L or any other suitable visual indication.

Figure 4:
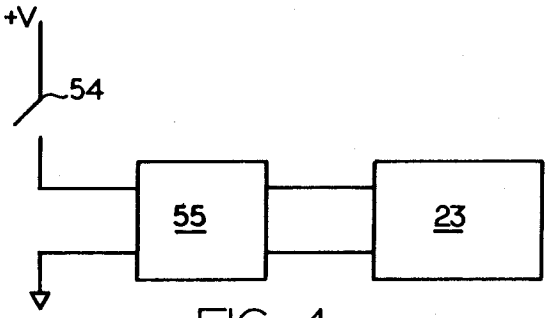
FIG. 4 is a circuit schematic of the back light control.

Back light control 24, as is shown in FIG. 4, uses a second SPST slide switch 54 for activating and deactivating the back light feature of display 23. Second slide switch 54 is connected to the enable input on backlight voltage supply 55.

Figure 5:
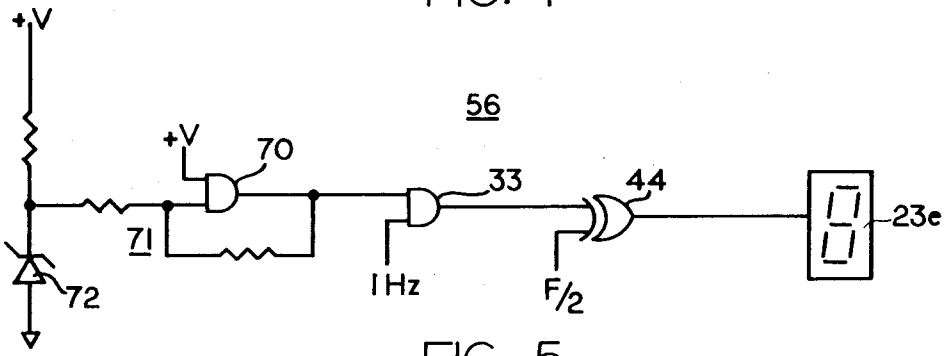
FIG. 5 is a circuit schematic of the low power supply indicator and display.

FIG. 5 shows a circuit schematic for a low power supply indicator 56 having a very low current drain. Low power supply indicator 56 takes advantage of the CMOS gate voltage thresholds. CMOS gates typically have a high/low voltage switching threshold which is equal to one-half the supply voltage. Here, a first input of first dual input CMOS AND gate 70 is connected to the power supply. The second input of AND gate 70 is connected to the cathode of a reverse biased zener diode 72, here an LM385 which provides a constant voltage reference. A hysteresis network 71 is provided to prevent the output of AND gate 70 from oscillating when the input voltage is a slowly changing signal. The output of AND gate 70 is connected to a first input of second dual input AND gate 73. Second AND gate 73 ANDs this first input signal with a one hertz signal to produce an oscillating low battery indicator enable signal. The enable signal is subsequently exclusive ORed, via a dual input exclusive OR gate 74 with a one-half base frequency signal to drive low battery supply subdisplay indicator **23*e*. When a low battery condition exists, indicator 23*e*** will blink at a one hertz rate.

Breast feeding timer 10 can be embodied in many forms, such as a wrist watch, desk top, etc. Additionally, a time of day clock could easily be incorporated to provide a full function embodiment. While breast feeding timer 10 is here explained as an electronic device, a similar mechanical or electromechanical device could be constructed.

Additional uses for the breast feeding timer include a medication interval timer for indicating how long it has been since the last dosage and for reminding that it is time for another dosage, via the alarm feature.

In use, the breast feeding mother would normally program a time interval into alarm counter 14, a typical value would be ten minutes, by selecting the alarm program mode via switch 35. Stop/start switch 38 is then used to advance the alarm time to the desired value, which is simultaneously displayed on display 23. Deselecting the alarm program mode via switch 35, will return the elapsed time to display 23. If desired, the timer can be stopped, reset and restarted using stop/-start switch 38 and reset switch 42. Once the programmed alarm time has elapsed, alarm 26 will sound, signaling to the mother to switch breasts and change breast indicator **23*d* by depressing switch 51**.

While there is shown and described the present preferred embodiment of the invention, it is to be distinctly understood that this invention is not limited thereto but may be variously embodied to practice within the scope of the following claims.

Accordingly, what is claimed is:

1. A breast feeding timer and breast indicating circuit which comprises:

timer means being configured to time an interval starting at the beginning of a first feeding and ending at the beginning of a second feeding;

alarm means being connected and responsive to said timer means for generating an alarm signal after a user programmed interval of time has expired since the initiation of a feeding;

timer control means being connected to said timer means for starting, stopping and resetting said timer means;

alarm program and control means being connected to said alarm means for programming an alarm time interval into said alarm means and for starting, stopping and resetting said alarm means;

right/left breast indicator selector and control means for alternately generating between right and left breast signals;

display means being connected to said timer means and said right/left breast selector and control means for displaying times corresponding to the amount of time elapsed since the initiation of a prior feeding, the amount of time expired since the initiation of a current feeding, the time duration of a feeding interval and an indication of either the right or left breast; and power supply means being connected to said timer means, said alarm means, said breast selector means; said timer control means; said alarm program and control means, and said display means for supplying energy to the same.

2. The circuit of claim 1 further comprising:

a back light being attached in juxtaposition to said display and disposed to illuminate said display to facilitate reading of said display in low ambient light conditions;

back light control means being connected to said back light and to said power supply means for selectively activating said back light.

3. The circuit of claim 2 further comprising:

a low power supply indicator being connected to said power supply means for monitoring the power level of said power supply means; and said display further being connected to said low power supply indicator and configured to display an indication of a low power supply condition.

4. The circuit of claim 3 wherein said right/left breast indicator selector and control means comprises:

a first debounced toggle switch for generating either a right or a left signal; and said display having a right and left indicator being connected to said toggle switch for displaying either a right or a left indication.

5. The circuit of claim 4 wherein said timer means and said timer control means comprise:

a frequency reference for generating clock pulses;

a second debounced toggle switch for generating timer enable and disable signals;

a first binary counter being connected to said frequency reference and said second toggle switch for counting said clock pulses and generating an output signal whose magnitude represents a particular time interval; and a first debounced momentary switch being connected to said counter for generating a reset signal to reset said counter.

6. The circuit of claim 5 wherein said alarm means and said alarm program and control means comprise:

a third debounced toggle switch for generating a program signal;

an alarm program clock being connected to said third toggle switch and to said second toggle switch for generating program clock pulses;

a second binary counter being connected to said alarm program clock for counting said program clock pulses and generating an output signal whose magnitude represents a programmed time interval; and comparator means for comparing the magnitudes of the first and second counter outputs for generating a alarm signal when the magnitudes are equal to one another.

7. The circuit of claim 6 wherein said display means comprises a three digit numerical LCD readout including a subdisplay having its segments disposed to alternately display a right or left breast indication.

8. The circuit of claim 1 wherein said right/left breast indicator selector and control means comprises:

a first debounced toggle switch for generating either a right or a left signal; and said display having a right and left indicator being connected to said toggle switch for displaying either a right or a left indication.

9. The circuit of claim 8 wherein said timer means and said timer control means comprise:

a frequency reference for generating clock pulses;

a second debounced toggle switch for generating timer enable and disable signals;

a first binary counter being connected to said frequency reference and said second toggle switch for counting said clock pulses and generating an output signal whose magnitude represents a particular time interval; and a first debounced momentary switch being connected to said counter for generating a reset signal to reset said counter.

10. The circuit of claim 9 wherein said alarm means and said alarm program and control means comprise:

a third debounced toggle switch for generating a program signal;

an alarm program clock being connected to said third toggle switch and to said second toggle switch for generating program clock pulses;

a second binary counter being connected to said alarm program clock for counting said program clock pulses and generating an output signal whose magnitude represents a programed time interval; and comparator means for comparing the magnitudes of the first and second counter outputs for generating a alarm signal when the magnitudes are equal to one another.

11. The circuit of claim 10 wherein said display means comprises a three digit numerical LCD readout including a subdisplay having its segments disposed to alternately display a right or left breast indication.

12. The circuit of claim 2 wherein said right/left breast indicator selector and control means comprises:

a first debounced toggle switch for generating either a right or a left signal; and said display having a right and left indicator being connected to said toggle switch for displaying either a right or a left indication.

13. The circuit of claim 12 wherein said timer means and said timer control means comprise:

a frequency reference for generating clock pulses;

a second debounced toggle switch for generating timer enable and disable signals;

a first binary counter being connected to said frequency reference and said second toggle switch for counting said clock pulses and generating an output signal whose magnitude represents a particular time interval; and a first debounced momentary switch being connected to said counter for generating a reset signal to reset said counter.

14. The circuit of claim 13 wherein said alarm means and said alarm program and control means comprise:

a third debounced toggle switch for generating a program signal;

an alarm program clock being connected to said third toggle switch and to said second toggle switch for generating program clock pulses;

a second binary counter being connected to said alarm program clock for counting said program clock pulses and generating an output signal whose magnitude represents a programed time interval; and comparator means for comparing the magnitudes of the first and second counter outputs for generating a alarm signal when the magnitudes are equal to one another.

15. The circuit of claim 14 wherein said display means comprises a three digit numerical LCD readout including a subdisplay having its segments disposed to alternately display a right or a left breast indication.

16. The circuit of claim 2 wherein said timer means and said timer control means comprise:

a frequency reference for generating clock pulses;

a second debounced toggle switch for generating timer enable and disable signals;

a first binary counter being connected to said frequency reference and said second toggle switch for counting said clock pulses and generating an output signal whose magnitude represents a particular time interval; and a first debounced momentary switch being connected to said counter for generating a reset signal to reset said counter.

17. The circuit of claim 16 wherein said alarm means and said alarm program and control means comprise:

a third debounced toggle switch for generating a program signal;

an alarm program clock being connected to said third toggle switch and to said second toggle switch for generating program clock pulses;

a second binary counter being connected to said alarm program clock for counting said program clock pulses and generating an output signal whose magnitude represents a programed time interval; and comparator means for comparing the magnitudes of the first and second counter outputs for generating a alarm signal when the magnitudes are equal to one another.

18. The circuit of claim 17 wherein said display means comprises a three digit numerical LCD readout including a subdisplay having its segments disposed to alternately display a right or a left breast indication.

19. The circuit of claim 2 wherein said timer means and said timer control means comprise:

a frequency reference for generating clock pulses;

a second debounced toggle switch for generating timer enable and disable signals;

a first binary counter being connected to said frequency reference and said second toggle switch for counting said clock pulses and generating an output signal whose magnitude represents a particular time interval; and a first debounced momentary switch being connected to said counter for generating a reset signal to reset said counter.

20. The circuit of claim 19 wherein said alarm means and said alarm program and control means comprise:

a third debounced toggle switch for generating a program signal;

an alarm program clock being connected to said third toggle switch and to said second toggle switch for generating program clock pulses;

a second binary counter being connected to said alarm program clock for counting said program clock pulses and generating an output signal whose magnitude represents a programed time interval; and comparator means for comparing the magnitudes of the first and second counter outputs for generating a alarm signal when the magnitudes are equal to one another.

21. The circuit of claim 20 wherein said display means comprises a three digit numerical LCD readout including a subdisplay having its segments disposed to alternately display a right or a left breast indication.

22. The circuit of claim 1 wherein said display means comprises a three digit numerical LCD readout including a subdisplay having its segments disposed to alternately display a right or a left breast indication.

* * * * *